United States Patent [19]

Dennhardt

[11] Patent Number: 4,506,709

[45] Date of Patent: Mar. 26, 1985

[54] CAPACITOR AND FILLING-LEVEL SIGNAL INDICATOR FOR FILLING ELEMENT OF CONTAINER-FILLING MACHINES FOR DISPENSING NON-CARBONATED OR CARBONATED LIQUIDS

[75] Inventor: Werner Dennhardt, Bad Kreuznach, Fed. Rep. of Germany

[73] Assignee: Seitz Enginger Noll Maschinenbau Aktiengesellschaft, Mannheim, Fed. Rep. of Germany

[21] Appl. No.: 487,254

[22] Filed: Apr. 21, 1983

[30] Foreign Application Priority Data

May 4, 1982 [DE] Fed. Rep. of Germany ..... 3216604

[51] Int. Cl.[3] ..... B65B 3/26

[52] U.S. Cl. ..... 141/95; 141/392; 141/83; 141/198; 73/304 C

[58] Field of Search ..... 141/83, 94–96, 141/192, 196, 198, 392; 361/327, 284; 73/304 C

[56] References Cited

U.S. PATENT DOCUMENTS

| | | | |
|---|---|---|---|
| 2,941,403 | 6/1960 | Steenfeld et al. | 73/304 C |
| 3,367,183 | 2/1968 | Webster | 73/304 C |
| 3,744,314 | 7/1973 | Lenny | 73/304 C |
| 4,122,718 | 10/1978 | Gustafson | 73/304 C |
| 4,295,370 | 10/1981 | Bristol | 361/284 |
| 4,308,569 | 12/1981 | Rheindorf | 141/95 |
| 4,373,389 | 2/1983 | Decker . | |
| 4,417,473 | 11/1983 | Tward et al. | 361/284 X |
| 4,418,571 | 12/1983 | Asmundsson et al. | 73/304 C |

*Primary Examiner*—Stephen Marcus
*Assistant Examiner*—Ernest G. Cusick
*Attorney, Agent, or Firm*—Becker & Becker, Inc.

[57] ABSTRACT

A filling element, used for dispensing non-carbonated or carbonated liquids having a high, a low, or no electrolytic conductivity includes a signal emitter embodied in the form of a cylindrical capacitor having an inner and an outer cylindrical electrode. The filling élement is usable for single or multi-chamber counterpressure filling machines having a lower valve housing which is provided with a pressurized gas chamber, and having a filling tube which is held by a contact pin for a filling height signal emitter, which contact pin is longitudinally movable in the valve housing. The signal emitter is essentially formed in that the liquid conveying part of the filling tube is insulated relative to the valve housing, and is embodied as an inner cylindrical electrode which is in contact with the contact pin. The outer cylindrical electrode, which is connected with a further contact pin, is arranged on the outer periphery of the inner cylindrical electrode, and an insulation is interposed between the two electrodes. The upper end of the outer cylindrical electrode extends into the pressurized gas chamber, and the lower end thereof extends beyond the pressurized gas chamber to below the level of the liquid rising in the container which is to be filled to the predetermined filling height.

7 Claims, 3 Drawing Figures

CAPACITOR AND FILLING-LEVEL SIGNAL INDICATOR FOR FILLING ELEMENT OF CONTAINER-FILLING MACHINES FOR DISPENSING NON-CARBONATED OR CARBONATED LIQUIDS

BACKGROUND OF THE INVENTION

The present invention relates to a filling element for container-filling machines for dispensing non-carbonated or carbonated liquids; the filling element is provided with a signal emitter which is responsive to the liquid at a predetermined filling height in the container which is to be filled.

With the aid of the filling elements of a filling machine, it is known to dispense, from a supply tank of the machine, flowing liquid into the container which is to be filled while observing a predetermined filling height. To this end, it is known to interrupt the supply of liquid to the container being filled as soon as the liquid which is rising in the container being filled during the filling process has reached the predetermined filling height. To accomplish this with electrically controlled filling elements, filling height determining signal emitters in the form of conductance probes are provided which extend into the container which is to be filled. The signal of such a probe, which signal is detected at the respectively predetermined filling height, is conveyed directly, or possibly after necessary processing, as a switching signal, while taking into consideration a correction factor, and with time delay, to the closing magnet of the actuating device which acts on the liquid flow valve of the filling element to close the liquid flow valve and to interrupt the supply of liquid (see U.S. Ser. No. 240,257, filed Mar. 4, 1981, now U.S. Pat. No. 4,386,635—Ahlers et al dated June 7, 1983which belongs to the assignee of the present application).

The heretofore known signal emitters for filling elements, which signal emitters are provided for detecting conductance, including the signal evaluation means associated therewith, essentially are suitable for liquids which have a high electrolytic conductance, but are not suitable for liquids having a low or no electrolytic conductance, because at low conductance the ratio of conductance to creep or leakage resistance is too unfavorable. However, since filling machines having such filling elements are used to dispense not only liquids having a high electrolytic conductance, such as wine, sparkling wine, champagne, and beer, but also liquids which have a low or no electrolytic conductivity, for example spirits such as gin, vodka, brandy, liqueurs, etc, into the container which is to be filled, filling machines having filling elements which are provided with signal emitters which respond to the conductance are therefore not suitable for dispensing these liquids.

It is an object of the present invention to improve the known filling elements, each of which has a signal emitter which responds to the liquid at a predetermined filling height in the container which is to be filled, in such a way that it is just as suitable for dispensing liquids which have not only a high but also a low or no electrolytic conductance.

BRIEF DESCRIPTION OF THE DRAWING

This object, and other objects and advantages of the present invention, will appear more clearly from the following specification in conjunction with the accompanying drawing, in which.

SUMMARY OF THE INVENTION

Figure 3:
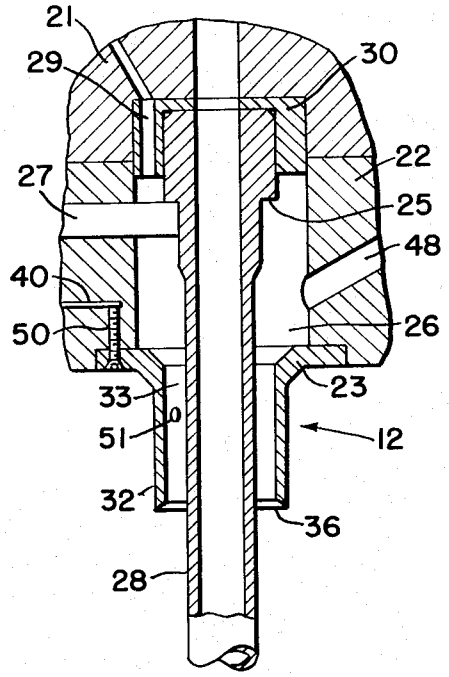
FIG. 3 shows another embodiment of the signal emitter in the region of the filling tube of a filling element.

The filling element of the present invention is characterized primarily in that the signal emitter is in the form of a cylindrical capacitor which is provided with an inner and an outer cylindrical electrode.

The cylindrical capacitor may be connected to an input of a comparator via a first resonant circuit which operates at a frequency $f_1$, with a second resonant circuit, which can be set to a predetermined frequency $f_2$, being connected to a further input of the comparator; the output of the comparator may be connected with a pulse shaper. The second resonant circuit may be provided for all of the filling elements of the filling machine, and the comparator of the respective filling element may be connected thereto.

The filling element of the present invention may be used for single or multi-chamber counterpressure filling machines for dispensing non-carbonated or carbonated liquids, and may be provided with a filling tube which projects from the filling element body downwardly into the press-on container which is to be filled and is provided with a signal emitter, and which is provided with a pressurized gas chamber housing which has a pressurized gas chamber and surrounds the filling tube in the region of the signal emitter with an annular gap-like outlet; in the pressurized gas chamber housing is longitudinally mounted a contact pin for electrical connection of the signal emitter to an evaluation circuit, and to hold the filling tube in the valve housing of the filling element. In order to be able to use a cylindrical capacitor of the aforementioned type in such a filling element, it is proposed pursuant to a further development of the present invention that the liquid conveying part of the filling tube be insulated relative to the valve housing, be embodied as the inner cylindrical electrode of the cylindrical capacitor, and be in contact with the contact pin. The outer cylindrical electrode of the cylindrical capacitor may be disposed on the outer periphery of the inner cylindrical electrode, with an insulating means being interposed between the electrodes. An upper end of the outer cylindrical electrode may extend into the pressurized gas chamber of the pressurized gas chamber housing, and a lower end of the outer cylindrical electrode may emerge out of the pressurized gas chamber housing to below the level of the liquid rising in the container which is to be filled to a predetermined filling height. A further contact pin may be disposed in the pressurized gas chamber housing in such a way as to be longitudinally movable. Within the pressurized gas chamber, this further contact pin may be in contact with the outer cylindrical electrode, and may be connected with the evaluation circuit via an electrical lead.

The outer cylindrical electrode may be held by compression on the outer periphery of the liquid-conveying inner cylindrical electrode, with an insulating means in the form of an elastic molded member being interposed between the two electrodes. The molded member may extend to the upper end of the outer cylindrical electrode, may be recessed from the upper end of the outer cylindrical electrode in order to form an annular gap, and may be provided with at least one groove which extends over its length.

The inventive filling element may also be provided for single or multi-chamber counterpressure filling machines for dispensing non-carbonated or carbonated liquids, and may be provided with a filling tube which projects out of the filling element body downwardly into the pressed-on container which is to be filled, a signal emitter which is disposed in the region of the filling tube, and a pressurized gas chamber housing of electrically insulating material which is provided with a pressurized gas chamber and, in the region of the signal emitter, surrounds the filling tube with an annular gap-like outlet. To electrically connect the signal emitter to an evaluation circuit, and to hold the filling tube in the valve housing of the filling element, a contact pin may be longitudinally movably disposed in the pressurized gas chamber housing. The annular gap-like outlet may be in the form of a sealing plate which comprises an electrically conducting material. For such a filling element, it is further proposed pursuant to the present invention that the liquid conveying part of the filling tube be insulated relative to the valve housing, be embodied as the inner cylindrical electrode of the cylindrical capacitor, and be in contact with the contact pin. The outer cylindrical electrode of the cylindrical capacitor may be formed on the sealing plate as a tubular extension which lengthens the annular gap-like outlet downwardly. The tubular extension ends below the level of the liquid rising in the container which is to be filled to a predetermined filling height, and is connected with an electrical lead which leads to the evaluation circuit.

The advantages obtained with the present invention consist especially in that now a single filling element can be used to dispense non-carbonated and carbonated liquids which have a high, a low, or no electrolytic conductivity. This is achieved in that to measure the predetermined filling height by means of the signal emitter, instead of using the conductivity, the capacitance, which changes in the signal emitter (which is embodied as a cylindrical capacitor) as the filling height changes, is utilized. It was realized that by coupling this capacitance to a resonant circuit, the frequency would change with a change of capacitance, so that another preselectable frequency which corresponds to the desired filling height value could be compared with the changing frequency, and the resulting signal of this comparison could be used as a switching signal, either directly or after successful processing, to terminate the supply of liquid to a container during the filling process.

DESCRIPTION OF THE PREFERRED EMBODIMENTS

Figure 1:
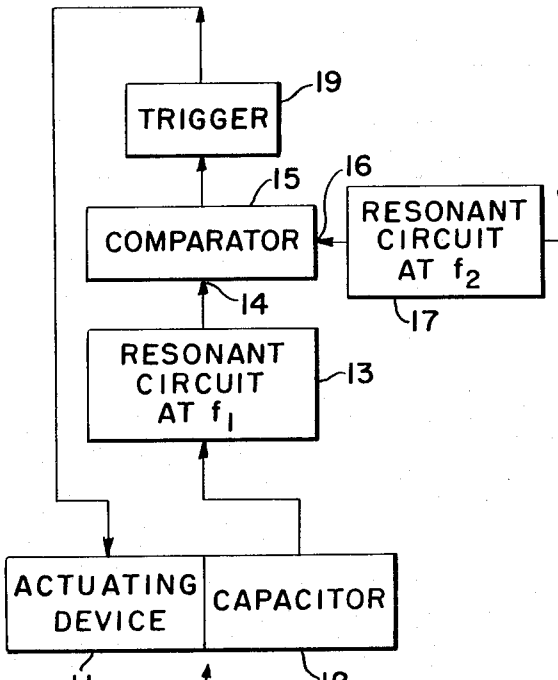
FIG. 1 is a block diagram showing a filling element, signal emitter, and evaluation circuit pursuant to the present invention.

Referring now to the drawings in detail, the block diagram illustrated in FIG. 1 shows the following part of a filling machine, which is complete in all particulars, for containers which are to be filled, especially bottles: a filling element 10 which is provided with a regulatable liquid flow valve and an actuating device 11 for the liquid flow valve, and a signal emitter in the form of a cylindrical capacitor 12 having an inner and an outer cylindrical electrode. The capacitor 12 is connected via electrical lines and via a first resonant circuit 13, which operates at a frequency $f_1$, to an input 14 of a comparator 15. A second resonant circuit 17 is connected to the further input 16 of the comparator 15. To set its sensitivity, the second resonant circuit is provided with a potentiometer 18, with which the predeterminable desired filling height value for the pre-set filling height can be set in the form of a frequency $f_2$, for example a frequency in the MHz range, which is conveyed to the comparator 15 for comparison with the actual filling height value, which is present in the form of the frequency $f_1$. The output of the comparator 15 is connected with a pulse shaper in the form of a trigger 19, which converts the signal resulting from the comparison which took place in the comparator 15 and which was accomplished between the actual filling height value ($f_1$) and the desired filling height value ($f_2$), into a signal which, directly or in some other manner, is conveyed, after first being converted to a switching signal, to the closing magnets of the actuating device 11; these closing magnets act on the liquid flow valve. The conversion can be accomplished in a non-illustrated control unit, for example a data processor, where, after the program requirements have been met, the converted signal of each of the filling elements 10 is converted into a switching signal. This switching signal is conveyed via the non-illustrated output control of the data processor to the closing magnets of the actuating device 11 of the respective filling element 10 to act on the liquid flow valve of the filling element 10 so that this valve assumes the closed position. With a filling machine having a plurality of filling elements 10, it is expedient to provide only one second resonant circuit 17 for all filling elements 10 of the filling machine, and to connect it with the respective comparator 15 of the filling element 10.

Figure 2:
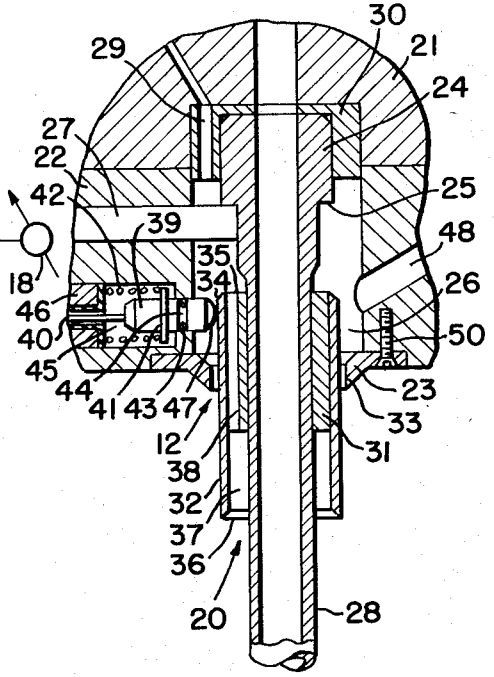
FIG. 2 shows one embodiment of the signal emitter at the filling tube of a filling element.

FIG. 2 shows only that region of a filling element, which is intended for single and multi-chamber filling machines and which has a long filling tube, which shows the filling tube of the filling element with the signal emitter. Such a filling element is described, for example, in U.S. Pat. No. 4,369,820, issued Jan. 25, 1983; this patent, which belongs to the assignee of the present application, is incorporated into the present specification by reference thereto. This aforementioned region of the filling element 10, with the filling tube 20, is essentially surrounded by the lower part of a valve housing 21, including the pressurized gas chamber housing 22 and the sealing plate 23 which is inserted therein. The pressurized gas chamber housing 22 is disposed on the lower side of the valve housing 21, and comprises an electrically insulated synthetic material, for example, Noryl. The filling tube head 24 of the filling tube 20 is inserted into the underside of the valve housing 21. The filling tube 20 is held in this position by a contact pin 27 which engages the shoulder 25 of the filling tube head 24, is installed in the pressurized gas chamber housing 22, and is guided into the pressurized gas chamber 26 of the pressurized gas chamber housing 22. At the same time, the contact pin 27 serves as an electrical connection. The liquid conveying portion of the filling tube 20, on which the filling tube head 24 with the shoulder 25 is provided, is embodied as the inner cylindrical electrode 28 of the cylindrical capacitor 12. In order to insulate the inner cylindrical electrode 28 relative to the stainless steel valve housing 21, a bushing 30 is interposed between the valve housing 21 and the filling tube head 24. The bushing 30 is made of insulating material, and may be provided with a pressurized gas inlet conduit 29. The insulation of the inner cylindrical electrode 28 relative to the valve housing 21 can also be effected by suitably coating the filling tube head 24, or can be eliminated if the valve housing 21 comprises an electrically insulating material.

The outer cylindrical electrode 32 of the cylindrical capacitor 12 is provided as a thin-walled stainless steel tube on the outer periphery of the inner cylindrical electrode 28 accompanied by the interposition of an insulating means, for example the outer cylindrical electrode 32 is surrounded by an annular gap 33 in the sealing plate 23. This annular gap 33 is large enough for the supply of pressurized gas and for the withdrawal of return gas. The upper end 35 of the outer cylindrical electrode 32 is provided with slip bevels 34, and projects into the pressurized gas chamber 26 of the pressurized gas chamber housing 22. The molded member 31 is flush with the upper end 35 of the outer cylindrical electrode 32; this upper end 35 is disposed far enough from the inner cylindrical electrode 28 to avoid liquid contact. The inner and outer diameters of the molded member 31 are oversized to such an extent that the outer cylindrical electrode 32 is seated firmly on the inner cylindrical electrode 28 merely by compression, so that the inner and outer cylindrical electrodes 28, 32, including the molded member 31, result in a structural unit which forms the filling tube 20. The lower end 36 of the outer cylindrical electrode 32 emerges from the pressurized gas chamber housing 22, or the sealing plate 23, to below the height of the liquid level which is rising in the container to the predetermined height. To form an annular gap 37, the molded member 31 is recessed from the lower end 36 of the outer cylindrical electrode 32. The molded member 31 is expediently provided with at least one groove 38 which extends over its length, or with a flattened portion which assures the equivalent through passage, so that liquid rise in the gap 37 is made possible by adquate withdrawal of gas out of the gap 37.

Spaced from, and below, the contact pin 27, which engages the shoulder 25 of the filling tube head 24 and is connected by means of an electrical lead to the first resonant circuit 13, there is provided a further contact pin 39 which comprises electrically conductive material, for example stainless steel, and which with the connected electrical lead 40 effects the electrical connection of the outer cylindrical electrode 32 to the first resonant circuit 13 of the evaluation circuit. This further contact pin 39 is in contact with the outer periphery of the outer cylindrical electrode 32 below the upper end 35 thereof. To accomplish this, the further contact pin 39 is disposed radially relative to the outer periphery of the outer cylindrical electrode 32, is supported by a collar 41 against a spring 42, and is disposed in the pressurized gas chamber housing 22 in such a way as to be longitudinally movable. A sealing ring 43, which is provided in a peripheral groove 44 of the further contact pin 39, locks off the pressurized gas chamber 26 from the receiving chamber 45, which surrounds the spring 42. The receiving chamber 45 is accessible from the outside by means of a closure member 46 which serves as support for the spring 42, and is provided with a through-hole for the electrical lead 40. That end 47 of the further contact pin 39 which is in contact with the outer cylindrical electrode 32 is spherical and, when the filling tube 20 is removed from the valve housing 21, extends so far into the pressurized gas chamber 26 that it is moved inwardly against the force of the spring 42, when the filling tube 20 is inserted, due to engagement against the slip bevels 34 on the outer cylindrical electrode 32. This extension of the spherical end 47 into the pressurized gas chamber 26 is limited by engagement of the collar 41 against the wall of the pressurized gas chamber housing 22.

The inventive filling element operates as follows: if prior to the beginning of the filling operation the desired filling height value, taking into consideration the essential parameters, such as the temperature of the liquid being filled, is set in the form of the pre-set frequency $f_2$ at the second resonant circuit 17 by means of the potentiometer 18, and thereby the filling height in the bottles which are to be filled is predetermined, for example of the height of the lower end 36 of the outer cylindrical electrode 32, with the closing of the liquid flow valve of the respective filling element 10 being brought about by the closing magnets of the actuating device 11, and a bottle which is to be filled is pressed onto a filling element 10 and the liquid supply into the bottle is released after successful pressurizing via the pressurized gas inlet conduit 29, then, as the liquid continues to rise, with the inner cylindrical electrode 28 being in contact with the liquid, and the return gas escapes via the annular gap 33 and the groove 38 into the pressurized gas chamber 26, from where it is withdrawn in a customary manner via the pressurized gas outlet conduit 48, the liquid level reaches the lower end 36 of the outer cylindrical electrode 32 at the predetermined height. In so doing, due to the change in capacitance taking place in the cylindrical capacitor 12, a signal in the form of the frequency $f_1$ acts on the first resonant circuit 13, and hence on the comparator 15. If the comparison taking place in the comparator 15 with the frequency $f_2$ supplied from the second resonant circuit 17 now results in an equivalence between the two frequencies $f_1$ and $f_2$, either directly or during continuing liquid rise and therefore changing frequency $f_1$, a resultant signal corresponding to the comparison is fed to the trigger 19 for conversion. The converted signal thereupon resulting at the output of the trigger 19 is converted, for example in a data processor, to a switching signal, and is subsequently conveyed to the closing magnets of the actuating device 11. By closing the liquid flow valve of the filling element 10, the actuating device 11 effects the interruption of liquid supply into the bottle.

FIG. 3 illustrates a variation which assures the previously described operation. This variation is advantageous if different types of bottles are to be filled with a given filling machine, with each type of bottle being of a different height, yet with the filling height for all bottle types being uniform. For such a case, where it is necessary for each type of bottle to exchange the filling tube 20 which extends to the bottom of the bottle, only the inner cylindrical electrode 28 of the filling tube 20, which electrode is designed for the supply of liquid into the respective bottle which is to filled, is exchanged, and the outer cylindrical electrode 32 is intergrated with the sealing plate 23 of the pressurized gas chamber housing 22; this sealing plate 23 comprises electrically conducting material, for example stainless steel. In this connection, the cylindrical electrode 32, i.e. the sealing plate 23, can be connected directly by means of the electrical lead 40 to the first resonant circuit 13 of the evaluation circuit without the interposition of a further contact pin 39. It is advisable to form the outer cylindrical electrode 32 in such a way that it is formed on the sealing plate 23 as a tubular extension which extends the annular gap 33 downwardly, and which ends below the height of the bottle which is to be filled at a predetermined filling height of the rising liquid level. This outer cylindrical electrode 32, which is formed from the sealing plate 23 and the tubular extension, and which is connected with the pressurized gas chamber housing 22 by means of removable fasteners, for example a plurality of screws 50, may be provided with a return-gas bore 51 which assures the withdrawal of return gas from the neck of the bottle even when the lower end 36 of the outer cylindrical electrode 32 is immersed below the level of the liquid. This aforementioned separation of the inner cylindrical electrode 28 from the outer cylindrical electrode 32 has the advantage that the filling tube 20 which is to be exchanged has a very simple construction and is very simple to manufacture, since it now only comprises the inner cylindrical electrode 28, thus resulting in elimination of the molded member 31 and the second contact pin 27.

The signal emitter in the form of the cylindrical capacitor 12 is not limited to the filling elements 10 with a short or a long filling element 20 as illustrated in the embodiments of FIGS. 2 and 3, but, with an appropriate configuration, is also suitable for filling elements having no filling tube, independent of the filling method which is utilized.

The present invention is, of course, in no way restricted to the specific disclosure of the specification and drawings, but also encompasses any modifications within the scope of the appended claims.

What I claim is:

1. A filling element, for container-filling machines, for dispensing carbonated or non-carbonated liquids; said filling element including a signal emitter which is responsive to said liquid at a predetermined filling height in a container which is to be filled; said signal emitter is in the form of a cylindrical capacitor, and is provided with an inner cylindrical electrode, and an outer cylindrical electrode, said filling element being intended for single and multi-chamber counter pressure filling machines, and including:

a filling element body in the form of a valve housing;

a filling tube which projects downwardly out of said valve housing into a pressed-on container which is to be filled, said filling tube having a liquid-conveying part and being provided with said signal emitter;

a pressurized gas chamber housing, of electrically insulating material, which is associated with said valve housing, is provided with a pressurized gas chamber, and is provided in the region of said signal emitter with an annular gap-like outlet which surrounds said filling tube;

an evaluation circuit;

a contact pin mounted in said pressurized gas chamber housing in such a way as to be longitudinally movable, said contact pin serving for electrical connection of said signal emitter with said evaluation circuit, and for holding said filling tube in said valve housing of said filling element; said liquid-conveying part of said filling tube being insulated relative to said valve housing, being formed as said inner cylindrical electrode of said cylindrical capacitor, and being in contact with said contact pin; said outer cylindrical electrode being disposed on the outer periphery of said inner cylindrical electrode; said outer cylindrical electrode having an upper end which extends into said pressurized gas chamber of said pressurized gas chamber housing, and a lower end which emerges from said pressurized gas chamber housing and extends below the level of liquid rising in said container which is to be filled to a predetermined filling height;

insulating means interposed between said inner cylindrical electrode and said outer cylindrical electrode;

a further contact pin disposed in said pressurized gas chamber housing in such a way as to be longitudinally movable; said further contact pin being in contact with said outer cylindrical electrode within said pressurized gas chamber;

an electrical lead, said further contact pin being connected with said evaluation circuit via said electrical lead.

2. A filling element according to claim 4, which includes:

a comparator having several inputs and an output;

a first resonant circuit which operates at a frequency $f_1$, with said cylindrical capacitor being connected via said first resonant circuit to one of said inputs of said comparator:

a second resonant circuit which can be set to a predetermined frequency $f_2$ is connected to a further one of said inputs of said comparator; and a pulse shaper connected to said output of said comparator.

3. A filling element according to claim 2, with container-filling machines including a plurality of filling elements being provided therewith; said second resonant circuit being provided for all of said filling elements; said comparator of a given filling element being connected to said second resonant circuit.

4. A filling element according to claim 1, in which said insulating means is in the form of an elastic molded member, with said outer cylindrical electrode being held on said molded member on said inner cylindrical electrode by means of compression of said molded member; in which said molded member extends to said upper end of said outer cylindrical electrode, and is recessed from said lower end thereof to form an annular gap; and in which said molded member is provided with at least one groove which extends over the length thereof.

5. A filling element, for container-filling machines, for dispensing carbonated or non-carbonated liquids; said filling element including a signal emitter which is responsive to said liquid at a predetermined filling height in a container which is to be filled; said signal emitter is in the form of a cylindrical capacitor, and is provided with an inner cylindrical electrode, and an outer cylindrical electrode, said filling element being intended for single and multi-chamber counter pressure filling machines, and including:

a filling element body in the form of a valve housing;

a filling tube which projects downwardly out of said valve housing into a pressed-on container which is to be filled, said filling tube having a liquid-conveying part, with said signal emitter being disposed in the region of said filling tube;

a pressurized gas chamber housing, of electrically insulating material, which is associated with said valve housing, is provided with a pressurized gas chamber, and is provided in the region of said signal emitter with an annular gap-like outlet which surrounds said filling tube;

a sealing plate, of electrically conducting material, associated with said pressurized gas chamber housing for forming said annular gap-like outlet;

an evaluation circuit;

a contact pin mounted in said pressurized gas chamber housing in such a way as to be longitudinally movable, said contact pin serving for electrical connection of said signal emitter with said evaluation circuit, and for holding said filling tube in said valve housing of said filling element; said liquid-conveying part of said filling tube being insulated relative to said valve housing, being formed as said inner cylindrical electrode of said cylindrical capacitor, and being in contact with said contact pin; said outer cylindrical electrode being formed on said sealing plate as a tubular extension which downwardly lengthens said annular gap-like outlet; that end of said tubular extension remote from said sealing plate ending below the level of liquid rising in said container which is to be filled to a predetermined filling height; and an electrical lead for connecting said tubular extension with said evaluation circuit.

6. A filling element according to claim 5, which includes:

a comparator having several inputs and an output;

a first resonant circuit which operates at a frequency $f_1$, with said cylindrical capacitor being connected via said first resonant circuit to one of said inputs of said comparator;

a second resonant circuit which can be set to a predetermined frequency $f_2$ and which is connected to a further one of said inputs of said comparator; and a pulse shaper connected to said output of said comparator.

7. A filling element according to claim 6, with container-filling machines including a plurality of filling elements being provided; said second resonant circuit being provided for all of said filling elements; said comparator of a given filling element being connected to said second resonant circuit.

* * * * *

UNITED STATES PATENT AND TRADEMARK OFFICE

CERTIFICATE OF CORRECTION

PATENT NO. : 4,506,709

DATED : 26 March 1985

INVENTOR(S) : Werner Dennhardt

It is certified that error appears in the above-identified patent and that said Letters Patent is hereby corrected as shown below:

On the title page, the correct spelling of the Assignee company is:

[73] Assignee: Seitz Enzinger Noll Maschinenbau Aktiengesellschaft, Mannheim, Fed. Rep. of Germany Signed and Sealed this

*Ninth* Day of *July 1985*

[SEAL]

*Attest:*

DONALD J. QUIGG

*Attesting Officer* *Acting Commissioner of Patents and Trademarks*